United States Patent [19]

Bengtsson

[11] 4,055,320

[45] Oct. 25, 1977

[54] CHAIR CLAMP AND RESTRAINT

[75] Inventor: Robert J. Bengtsson, Colorado Springs, Colo.

[73] Assignee: AMI Industries, Inc., Colorado Springs, Colo.

[21] Appl. No.: 715,125

[22] Filed: Aug. 17, 1976

[51] Int. Cl.[2] ..... A47C 7/00

[52] U.S. Cl. ..... 248/501; 248/25

[58] Field of Search ..... 248/501, 502, 503, 505, 248/500, 510, 25, 158, 188.1, 346; 16/1 R; 297/463

[56] References Cited

U.S. PATENT DOCUMENTS

| | | | |
|---|---|---|---|
| 1,335,842 | 4/1920 | Lambert | 248/501 |
| 2,266,852 | 12/1941 | Cunningham | 248/501 |
| 2,517,411 | 8/1950 | Patterson | 248/505 X |
| 3,148,379 | 9/1964 | Muller | 248/502 X |
| 3,392,954 | 7/1968 | Malitte | 248/501 X |
| 3,486,204 | 12/1969 | Hurtner et al. | 248/501 X |
| 3,747,887 | 7/1973 | Binkley | 248/501 |

FOREIGN PATENT DOCUMENTS

| | | | |
|---|---|---|---|
| 479,783 | 2/1938 | United Kingdom | 248/500 |

*Primary Examiner*—J. Franklin Foss
*Attorney, Agent, or Firm*—W. Britton Moore

[57] ABSTRACT

A device for mounting chairs relative to the floor mounting tracks or rails in railroad dining cars and aircarft and the like so as to permit sliding movement of the chairs but restrains them from being dislodged and upset in the event of accidents or sudden stops. This device includes a bracket anchored to a floor rail and spanning & clampingly engaging the lower leg portions of a chair so that the latter may slide fore and aft relative to the bracket and rail and yet be restrained against other movements.

4 Claims, 4 Drawing Figures

CHAIR CLAMP AND RESTRAINT

This invention relates to a bracket device for clamping the lower leg portions of dining room type chairs for railroad cars and aircraft so as to permit fore and aft sliding adjustment but acts as a restraint against other movements.

The principal object of the present invention is to provide a bracket for mounting railroad dining car type chairs relative to floor mounting rails so as to permit reciprocal adjusting movements and yet restrain it against other movement in the event of accidents or sudden stops.

Another object is the provision of a bracket having means for anchoring to a floor mounting rail in a railroad dining car or aircraft so as to span and clamp the lower leg portions of a chair and permit fore and aft movement thereof but which will retain the chair in upright position and restrain it against other movements.

Still another object is the provision of a bracket having a flat midsection adjustably and fixedly anchored to a floor mounting rail and having inverted generally U-shaped tie down clamps on opposing ends for embracing the leg portions of a chair so as to retain it in upright position but will permit reciprocal sliding adjustment thereof relative to the clamp and rail.

A further object is to provide a floor mounting bracket having slots therein for receiving a mounting bolt anchored in a floor mounting rail so as to permit lateral adjustment relative to the chair leg portions, but wherein the clamp portions on the opposing ends will so engage the leg portions that the chair will be retained in upright position but may be adjusted fore and aft relative to a table.

A still further object to provide a floor mounting and restraining bracket fixedly but adjustably mounted in a floor mounting rail and adapted to span and so clamp the lower leg portions of a chair that the latter will be retained in upright position and yet may be slidably and reciprocably adjusted relative to other chairs or a table.

These and other objects and advantages will be apparent as the specification is considered with the accompanying drawings, wherein.

Figure 1:
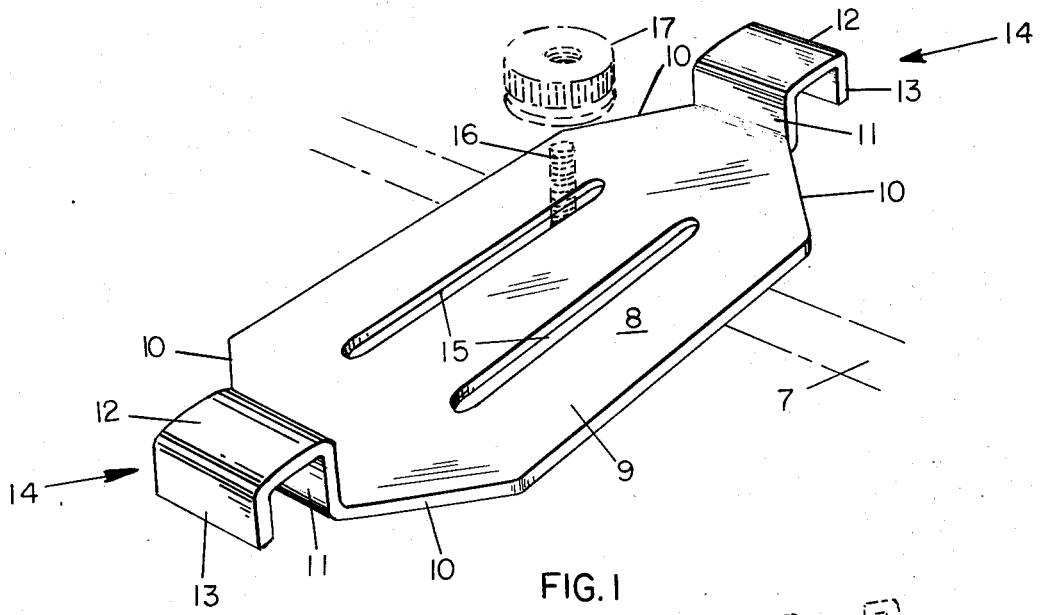
FIG. 1 is a perspective view of a restraining clamp or tie-down with a mounting bolt anchored in a floor mounting rail extending upwardly through one of two slots therein.

Referring more particularly to the drawings, wherein like reference characters designate like parts throughout the several views, numeral 1 generally identifies a conventional dining room type chair, having seat 2, upright back 3, and downwardly depending legs 4, with the front and back legs being interconnected by elongated frame members 5. This type of chair is usually of suitable metal or plastic tubular formation with the spacing between the two front and two rear legs being open, and the chair is maintained in upright position by frame members 5 flatly engaging carpeting or other floor surface 6 of a railroad dining car or aircraft, not shown, in an obvious manner. It is conventional to arrange metal mounting tracks or rails in the floor of this type of vehicular equipment for the purpose of assembling and anchoring partitions and other furnishings and accessories thereon, which tracks or rails usually extend longitudinally or lengthwise of the car so as to permit the assembly of mounting or anchoring bolts wherever desired. Such a track or rail 7 is shown herein and includes an elongated channel suitably inset in the floor and accessible through the carpeting or other floor covering. For example, tables, not shown, arranged in the usual spaced relationship, may be anchored to such a track or rail, as are dining chairs grouped at the sides thereof in the conventional and obvious manner.

Figure 2:
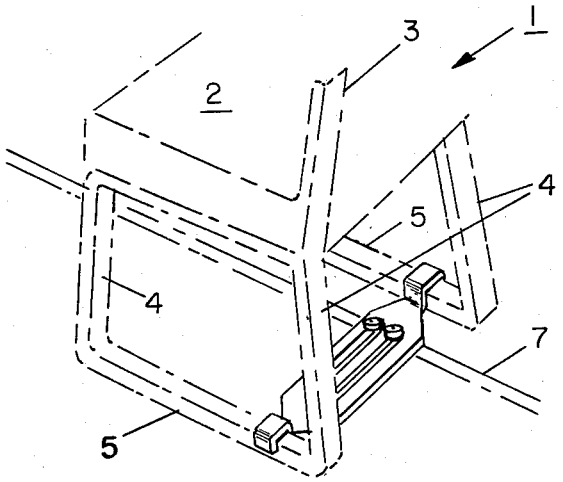
FIG. 2 is a perspective view of the clamp bolted to a floor mounting rail in the position it assumes when assembled relative to the lower leg portion of a chair.
Figure 3:
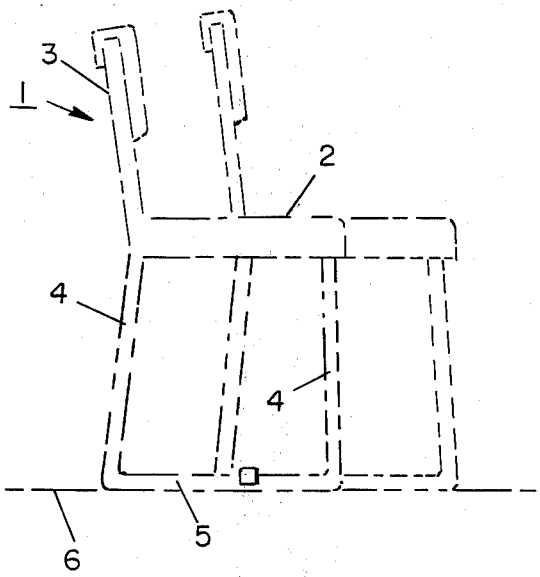
FIG. 3 is a side elevation of a chair when so engaged by a clamp or tie-down that fore and aft movements of the chair are permitted.

Referring in particular to FIGS. 1 and 2, a clamping bracket or tie-down 8 of suitable material, such as metal or plastic, is formed with a relatively wide flat midsection 9 which is reduced and tapered inwardly at its opposing ends, as at 10, with each end being bent upwardly at 11, outwardly at 12, and thence downwardly at 13, to provide generally inverted U-shaped clamps 14. A pair of spaced elongated slots 15 are formed in and terminate short of the ends of midsection 9 so that vertical bolts 16 suitably anchored in track or rail 7 may project upwardly through either one or both of the slots and may be interconnected therewith by nuts or the like 17.

As a chair on each side of a table will straddle a track or rail 7, with the bottom leg frame members 5 being disposed generally parallel thereto, when it is desired to mount a chair in its desired location, a bracket 8 is disposed crosswise of the track so that the slots 15 thereof are aligned with and receive either one or both track bolts 16 and nuts 17. The bracket may then be slidably adjusted relative to and before tightening nuts 17 so as to align and cause clamps 14 to interfit over and snugly engage leg frame members 5, as best shown in FIG. 2. When the chair and bracket are positioned as desired, nuts 17 are tightened to retain the bracket in a fixed position. Thus, the bracket spans and so engages with the leg frame members that lateral movement of the chair relative to track 7 is prevented. However, clamps 14 so embrace the frame members that sliding reciprocal movement therebetween is possible, so that the chair may be suitably adjusted fore and aft of the table to suit its occupant. It will be apparent that the flat underside of the bracket midsection 9 will generally parallel and flatly engage and slide over the surface of the carpet during such adjusting movements. In addition, it is to be noted that loosening of nuts 17 will enable lateral adjustment of the bracket and chair relative to track 7 to be effected.

Figure 4:
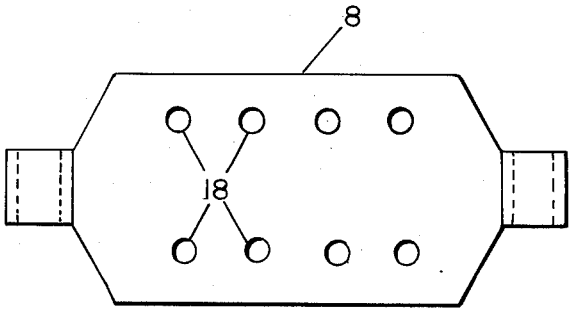
FIG. 4 is a top plan view of a modified clamp with a series of spaced bolt receiving apertures for receiving the floor mounting rail anchoring bolts.

In the modification of FIG. 4, in lieu of the parallel elongated slots 15 of the preferred embodiment, two rows of spaced apertures 18 are provided in the wide flat midsection 9 of clamp 8 so that the anchoring bolts may be suitably arranged therein to effect suitable lateral positioning.

While a preferred embodiment and modification of my restraining clamp and tie-down has been shown, it is to be understood that various changes and improvements may be made therein without departing from the scope and spirit of the appended claims.

What I claim:

1. In combination with a chair having legs and leg frame members, said frame members connecting the front and rear legs, and a mounting track on a mounting surface for said chair, of a chair mounting bracket extending at right angles to said track and spans said leg frame members, said bracket including a generally flat midsection, generally inverted U-shaped clamp means at opposing ends of said bracket, apertured means in said midsection, and bolt means anchored in said track received in said apertured means, said clamp means fitting over and interengaging with said leg frame members whereby said chair is slidably adjustable relative to said bracket and track during reciprocable movement of said chair but restrained from other movements.

2. In a clamping bracket device according to claim 1, wherein said apertured means includes elongated slot means in said midsection, and bolt means anchored in said track received in said slot means.

3. In a clamping bracket device according to claim 1, wherein said apertured means includes spaced apertures in said midsection, and bolt means anchored in said track received in at least one of said apertures.

4. In a clamping bracket device according to claim 2, wherein nut means on said bolt means fixedly anchors said bracket to said track.

* * * * *